US008122618B2

(12) United States Patent
Van Rompay

(10) Patent No.: US 8,122,618 B2
(45) Date of Patent: Feb. 28, 2012

(54) METHOD FOR REMOVING ALLUVIAL DEPOSITS FROM THE BOTTOM OF A WATERY AREA

(76) Inventor: Boudewijn Gabriël Van Rompay, Clearwater, FL (US)

( * ) Notice: Subject to any disclaimer, the term of this patent is extended or adjusted under 35 U.S.C. 154(b) by 211 days.

(21) Appl. No.: 12/372,317

(22) Filed: Feb. 17, 2009

(65) Prior Publication Data

US 2009/0206041 A1 Aug. 20, 2009

(30) Foreign Application Priority Data

Feb. 18, 2008 (BE) ..... 2008/0096

(51) Int. Cl.
*E02F 3/88* (2006.01)

(52) U.S. Cl. ..... 37/195; 37/317

(58) Field of Classification Search ..... 37/307, 37/314, 317, 321, 323, 195, 330, 331, 343, 37/466; 166/356; 403/228; 405/73, 163, 405/226; 415/199.9, 80, 81; 416/124, 128, 416/129

See application file for complete search history.

(56) References Cited

U.S. PATENT DOCUMENTS

| | | | | | |
|---|---|---|---|---|---|
| 635,270 | A | | 10/1899 | Rix et al. | |
| 2,006,037 | A | * | 6/1935 | Woodruff | 37/313 |
| 2,145,753 | A | * | 1/1939 | Coulter | 209/1 |
| 3,353,364 | A | * | 11/1967 | Blanding et al. | 405/189 |
| 3,661,204 | A | * | 5/1972 | Blanding et al. | 166/356 |
| 3,693,272 | A | * | 9/1972 | Gariel | 37/309 |
| 3,815,267 | A | * | 6/1974 | Laarman | 37/317 |
| 3,967,393 | A | * | 7/1976 | Nixon | 37/321 |
| 4,053,181 | A | | 10/1977 | Saito | |
| 4,127,950 | A | * | 12/1978 | Tillinghast et al. | 37/322 |
| 4,255,068 | A | * | 3/1981 | Valantin | 405/195.1 |
| 4,318,641 | A | * | 3/1982 | Hogervorst | 405/224 |
| 4,345,854 | A | * | 8/1982 | Valantin | 405/159 |
| 4,353,174 | A | * | 10/1982 | Maloblocki | 37/309 |
| 4,409,746 | A | * | 10/1983 | Beck | 37/317 |
| 4,432,671 | A | * | 2/1984 | Westra et al. | 405/226 |
| 4,456,424 | A | * | 6/1984 | Araoka | 415/121.2 |
| 4,558,744 | A | * | 12/1985 | Gibb | 166/335 |
| 4,674,917 | A | * | 6/1987 | Perrier et al. | 405/223 |

(Continued)

FOREIGN PATENT DOCUMENTS

DE 39 23 113 A1 1/1991

(Continued)

OTHER PUBLICATIONS

Search Report of European Patent Office in Belgium Patent Application No. Be 2008/00096, Sep. 2008.

*Primary Examiner* — Robert Pezzuto
(74) *Attorney, Agent, or Firm* — Bacon & Thomas, PLLC

(57) ABSTRACT

Method and device for removing alluvial deposits from the bottom of a watery area, whereby the layer of alluvial deposits (6) situated on the bottom (13) is carried to a place of discharge (16) and whereby the removal of the alluvial deposits (6) takes place under a diving bell (2) placed on or in the vicinity of the water bottom (13) and in which an air pressure is generated which is practically equal to or larger than the pressure of the water column measured outside the diving bell (2) as of the lower edge (5) of the diving bell (2) up to the water line (17), characterized in that the alluvial deposits (6) are sucked in in situ by a pump (14) and are carried to the place of discharge (16) via a tube (15).

9 Claims, 4 Drawing Sheets

U.S. PATENT DOCUMENTS

Figure 1:
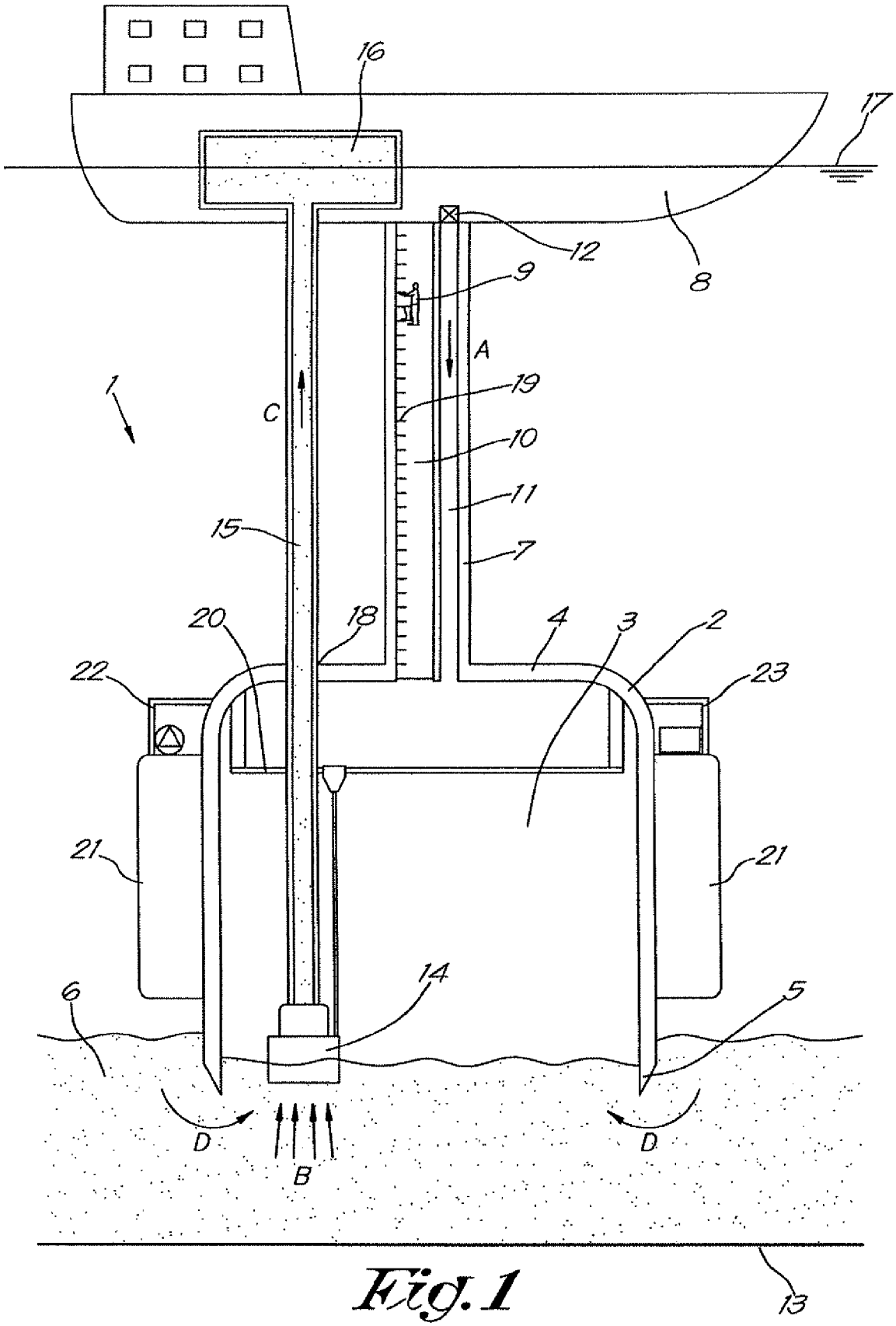

| | | | | |
|---|---|---|---|---|
| 4,830,541 | A * | 5/1989 | Shatto | 405/226 |
| 4,854,058 | A * | 8/1989 | Sloan et al. | 37/323 |
| 5,950,732 | A * | 9/1999 | Agee et al. | 166/354 |
| 6,189,243 | B1 | 2/2001 | Oikawa | |
| 6,612,251 | B1 * | 9/2003 | Ness | 114/66 |
| 6,659,182 | B1 * | 12/2003 | Saugier et al. | 166/358 |
| 7,621,059 | B2 * | 11/2009 | McCoy et al. | 37/317 |
| 7,753,126 | B2 * | 7/2010 | Reddoch, Sr. | 166/357 |

FOREIGN PATENT DOCUMENTS

| | | |
|---|---|---|
| EP | 2 090 699 A3 | 4/2010 |
| JP | 60-73921 | 4/1985 |
| JP | 2-248535 | 10/1990 |
| JP | 3-151421 | 6/1991 |
| JP | 2001-279707 | 10/2001 |
| JP | 2004-003210 | 1/2004 |

* cited by examiner

METHOD FOR REMOVING ALLUVIAL DEPOSITS FROM THE BOTTOM OF A WATERY AREA

The present invention concerns a method for removing alluvial deposits from the bottom of a watery area.

In particular, the method concerns the submerged pumping of polluted alluvial deposits with minimal turbulence.

It is generally known that the alluvial deposits of maritime waterways can be polluted with toxic chemicals and heavy metals as a result of accidental or illegal discharges or seeping away from industrial sites. As the environmental safety standards become more and more severe, the fraction of alluvial deposits which may be regarded as polluted grows, and the issue gains in importance.

A practical example to be considered is tributyltin (TBT), which has often been used as a major component of ship paints since the sixties of the twentieth century in order to repel marine organisms from hulls. Since it became clear that the accumulation of TBT in dock areas has a negative effect on marine organisms that were not aimed at, the use of TBT has been gradually banished worldwide. Although the presence of TBT in ships paints has been prohibited as of 1 Jan. 2008, TBT is still found in the alluvial deposits of dock areas and maritime waterways. It is very likely that these alluvial deposits will be regarded as polluted by more and more public bodies and will have to be removed from the bottom of the watery areas concerned.

There is a problem in that the present dredging techniques for removing alluvial deposits from the bottom of a watery area are often relatively inefficient in that they create a lot of turbulence, as a result of which the alluvial deposits are turned up.

Said turning up during the dredging activities increases the water content in the alluvial deposits. This is disadvantageous in that the moisture content will have to be partly or entirely removed when cleaning up the alluvial deposits that are brought to the surface.

An increased moisture content makes the dredging process relatively more expensive and the cleaning of the alluvial deposits more time-consuming.

Another disadvantage of the produced turbulence is that the turned-up polluted alluvial deposits spread over the watery area and may be mixed with the non-polluted alluvial deposits, whereas the dredging and removal of alluvial deposits has to be kept in situ as much as possible.

In order to remove alluvial deposits in situ, one could for example lower a pipe to the layer of polluted alluvial deposits which is connected to a pump situated on the shore or on a vessel. This may cause problems, however, in that the diameter of the pipe should not be too large so as not to produce too much turbulence when the pipe is being shifted or moved. Experiments have shown that the turbulence is restricted when the pipe has a diameter of less then 6 inches (15 cm).

A disadvantage of such a thin pipe is that the removal of a large volume of alluvial deposits becomes very time-consuming and hence expensive.

As traditional techniques for removing alluvial deposits produce much turbulence or are too expensive, this has for a result that public bodies tend to leave watery areas which are known to have a polluted alluvial deposit layer as they are, so as not to risk any spreading of the pollution due to any inefficient removal and turning up.

This entails a lot of disadvantages. Thus, some dock areas are not deepened or developed any further, and large areas of great economic value remain unused.

The present invention aims to remedy these and other disadvantages.

To this end, the present invention concerns a method for removing alluvial deposits from the bottom of a watery area whereby the alluvial deposit layer situated on the bottom is carried to a place of discharge and whereby the alluvial deposits are removed under a diving bell, placed on or near the bottom of the water and in which an air pressure is generated which is practically equal to or larger than the pressure of the water column measured outside the diving bell as of the lower edge of the diving bell up to the water line, whereby the alluvial deposits are sucked up in situ by a pump and are carried to the place of discharge via a tube.

An advantage of this method is that little turbulence is produced when the alluvial deposits are sucked up by means of a pump, as a result of which hardly any alluvial deposits or none at all are turned up outside the diving bell. This is particularly important in cases where the alluvial deposits are polluted by chemicals.

An additional advantage is that alluvial deposits in the vicinity of the diving bell are sucked up as well, such that a flow of alluvial deposits from the surroundings to the pump is created inside the diving bell. This is advantageous for the removal process and it increases the efficiency.

The method preferably uses a diving bell which is connected to a vessel by means of a shaft.

This offers the advantage that a diver can go down the shaft from the vessel and enter the diving bell for inspection or operational activities.

This also offers the advantage that one can work at a large depth if the shaft is sufficiently long.

The method preferably uses a conventional plunger pump or another piston pump.

The invention also concerns a device that can be used with a method according to the invention.

In order to better explain the characteristics of the invention, the following preferred embodiments are described by way of example only without being limitative in any way, with reference to the accompanying drawings, in which:

FIGS. 1, 2, 3, and 4 schematically represent a vertical cross section of a device according to the invention so as to illustrate the method.

FIG. 1 shows a device 1 with which the method according to the invention can be carried out.

The device 1 consists of a diving bell 2, designed as a chamber 3 which is closed all around and which is open towards the bottom and which is confined laterally and at the top by a surrounding, closed wall 4. The wall 4 has a tapered lower edge at the bottom, hereafter called the cutter 5, with which the diving bell 2 can penetrate into an alluvial deposit layer 6 and can partly separate the alluvial deposits situated inside the chamber 3.

At the top of the wall 4, the diving bell 2 is preferably connected to a shaft 7 which connects the diving bell 2 to a vessel B.

A diver 9 can descend this shaft as of the vessel 8 and enter the diving bell 2 via a lock 10, and air can be pumped in a pressure pipe 11 according to arrow A with the known means 12.

The diving bell 2 is lowered near or on the bottom 13 so as to remove the layer of alluvial deposits 6 there with a pump 14 provided in the room 3. The pump 14 carries the sucked-up alluvial deposits via a tube 15 to a place of discharge 16, for example in the shape of a hold or reservoir in the vessel 8, situated on a water line 17. The tube is preferably guided through a water-tight opening 18 of the wall 4 of the diving bell, but it can possibly also run through a segment of the shaft 7.

Optionally, a number of additional aids can be provided. Thus, means can be provided through which a diver 9 can enter the diving bell 2 via the shaft 7. This may be a lift 6, but in the case of FIG. 1 they are just steps 19.

At the top of the wall 4 of the chamber 3 can also be provided a guide 20 which is connected to the pump 14 and with which the pump 14 can be positioned via a control system, which is not shown in the figures. Optionally, the guide can guide the pump 14 vertically as well as horizontally.

Floating tanks 21 can be provided on the wall 4 of the diving bell 2 to lower and rise the diving bell 2. A pump chamber 22 can hereby adjust the ballast of the floating tanks 21.

The method for removing alluvial deposits according to the invention with a device 1 according to FIG. 1 is simple and as follows.

After the diving bell 2 has been lowered from the water level 17 into the alluvial deposit layer 6 by adjusting the ballast in the floating tanks 21, air is pumped into the diving bell 2 according to arrow A.

As a result, the chamber 3 of the diving bell 2 is put under such an air pressure that the water is pushed away as the air pressure is practically equal to or larger than the water column which is determined by the height between the lower edge of the cutter 5 and the water line 17.

In order to avoid as much turbulence as possible, said pressure in the chamber 3 is preferably set as soon as the diving bell 2 is launched, after which the diving bell 2 is gradually lowered into the alluvial deposit layer 6. The simplest way to do this, is by measuring the depth of the watery area with a sonar and by setting the pressure at the pressure of the water column having a height from the bottom 13 to the water line 17.

Next, the pump 14 is activated with the known means and alluvial deposits are sucked up in situ, as indicated by arrows B, and pumped to the place of discharge 16 in the vessel 8 via the tube 15 according to arrow C.

The pump 14 can hereby be positioned by means of a GPS system or the entire diving bell 2 can be positioned with known means, whereby a precisely determined route can then be programmed for the on-site removal of the alluvial deposits.

The turbulence which is produced in the alluvial deposit layer 6 is restricted, and polluted alluvial deposits are prevented from being driven out of the diving bell 2. Better still, thanks to the under pressure at the pump 14 in diving bell 2, alluvial deposits outside the chamber 3 will be sucked in under the cutter 5 according to arrows D. This not only provides more control over the removal of alluvial deposits in situ, the pressure in the chamber 3 provides for an inwardly directed turn-over movement, as opposed to traditional techniques whereby the turn-over movement is always directed outward. This is advantageous, for the removal of the alluvial deposits will be more efficient on the one hand, and polluted alluvial deposits are prevented from being spread on the other hand.

Figure 4:
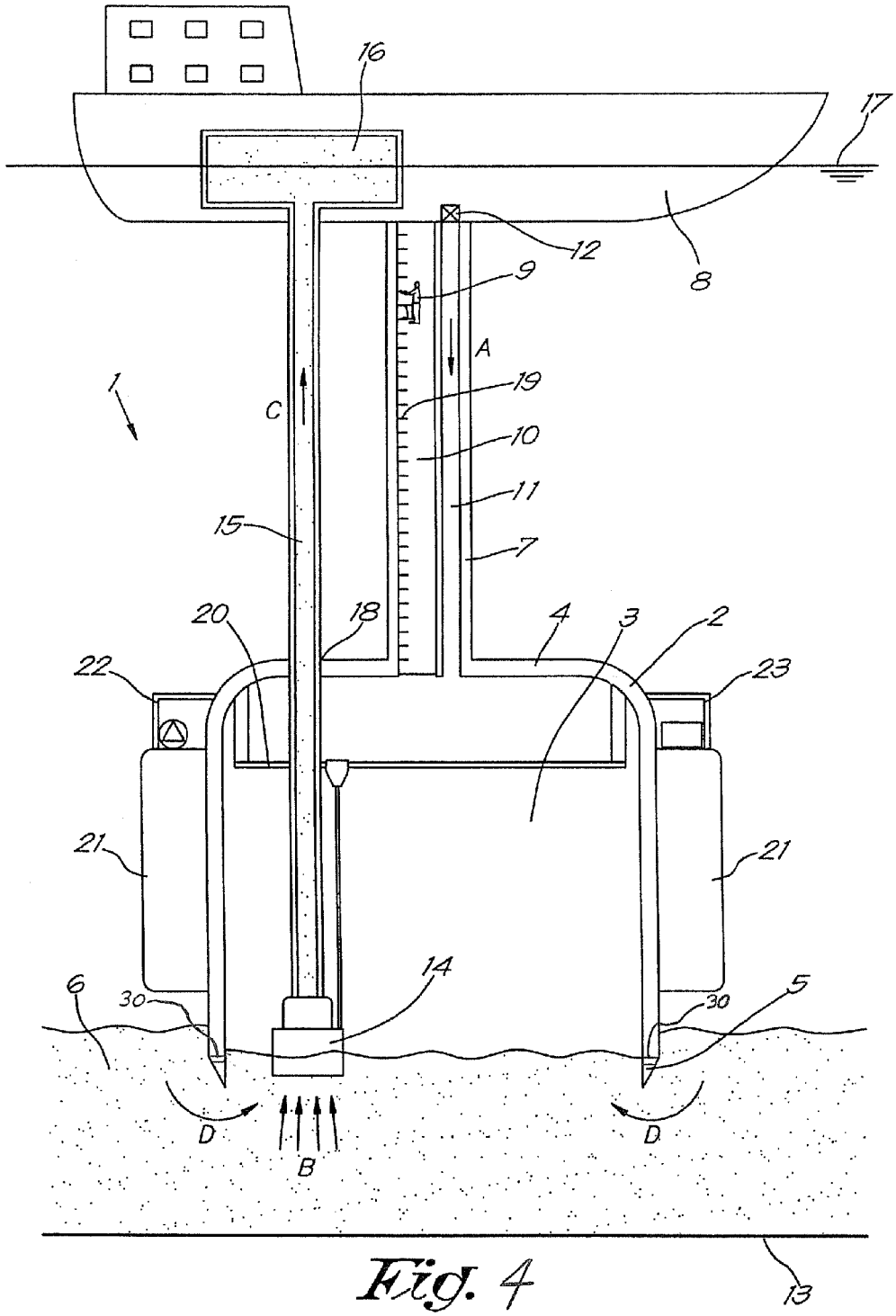

In order to further stimulate said inward turn-over movement, openings 30, as shown in FIG. 4, can be provided in the cutter 5 of the diving bell. Thus, alluvial deposits can be sucked in from outside the diving bell 2 after the diving bell 2 has been lowered to the bottom 13 with its cutter 5.

It is also possible that the cutter 5 of the diving bell is situated right above the alluvial deposit layer 6 and that the pump 14 then protrudes under the cutter 5 and penetrates in the alluvial deposit layer 6. Means for vertically rising and lowering the pump can be provided to that end in co-operation with the aforesaid guide 19.

It is also possible that the cutter 5 of the diving bell is situated at the height of the alluvial deposit layer 6 and that the diving bell 2 is put under such an air pressure that the water is pushed away as the air pressure is practically equal to, but in fact somewhat smaller than the water column which is determined by the height between the lower edge of the cutter 5 and the water line 17.

Figure 2:
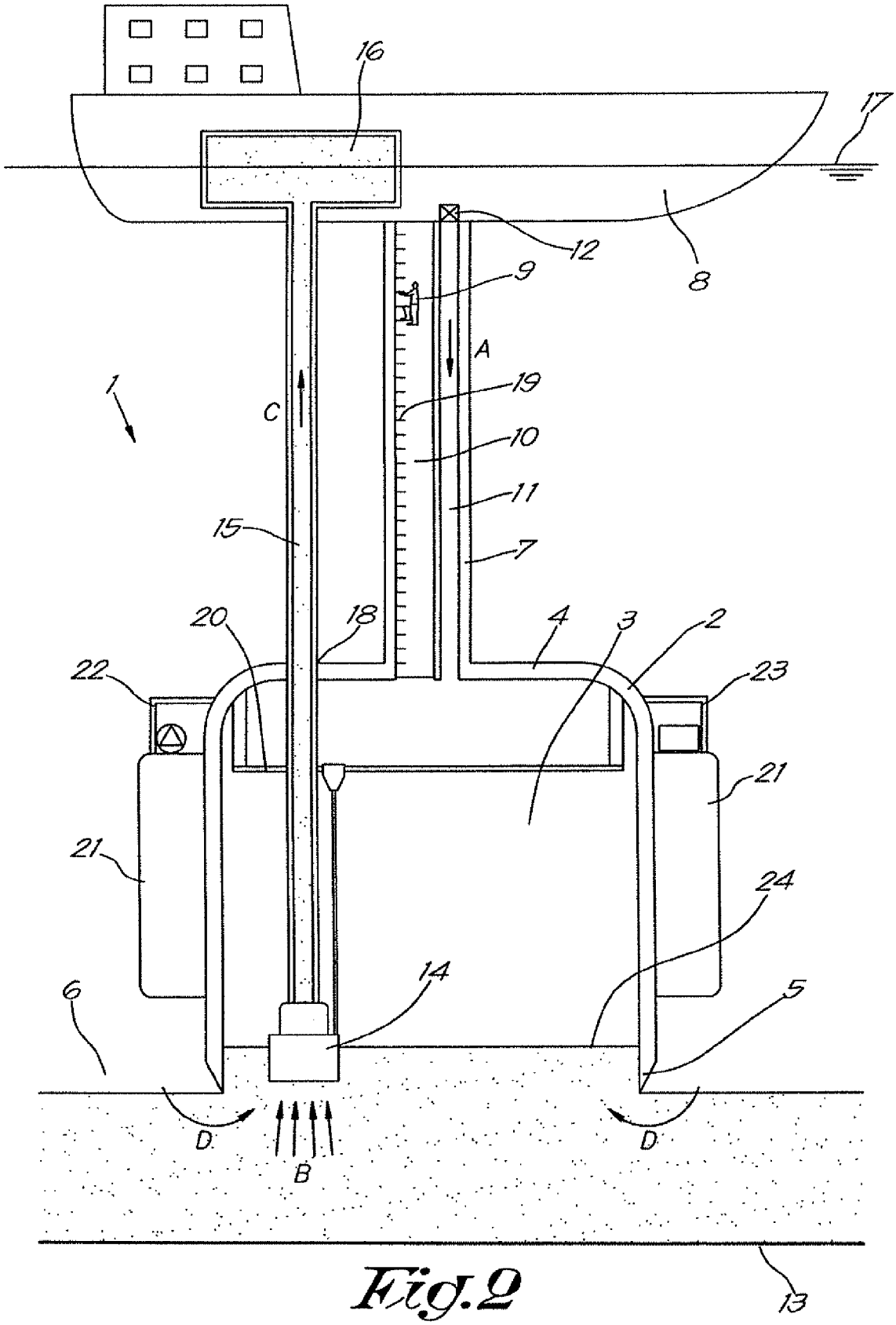

With this method, as shown in FIG. 2, the air pressure of the diving bell 2 is set to the water column which is determined by the height of a water line 24 in the chamber 3 in relation to the water line 17 of the surroundings.

This method enables a small volume of water and/or alluvial deposits to penetrate inside the chamber 3 so as to improve the sucking action at the pump 14. For, a small volume of water and/or alluvial deposits inside the chamber 3 makes it possible to vary the relative density of the sucked-up alluvial deposits in situ, i.e. in this case inside the chamber 3, and to further minimize the generated turbulence.

However, the air pressure inside the chamber 3 will then remain practically equal to the water column which is determined by the height between the lower edge of the cutter 5 and the water line 17.

Practically, the aim is to make a height of 20 to 30 cm of water and/or alluvial deposits enter the chamber 3. When working at a depth of for example 30m, the water column of the lower edge of the cutter 5 up to the water line 17 will amount to 3 bar, and the set pressure in the diving bell 2 will be equivalent to the water column with a height of the water line 24 in the chamber 3 up to the water line 17 of the surroundings, namely 2.97 bar, i.e. a difference of 1%.

FIG. 1 shows a device 1 whereby the diving bell 2 is connected to the vessel 6 by means of a shaft 7, but it is not excluded that a diving bell 2 is only connected to the vessel 6 by means of a cable. This cable may be used for example to lower and raise the diving bell as is the case with older diving bell systems. If the diving bell 2 is equipped with floating tanks 21, then the cable may be used for example for telecommunication services. A diver 9 can then enter and leave the diving bell 2 via the underside of the chamber 3.

Figure 3:
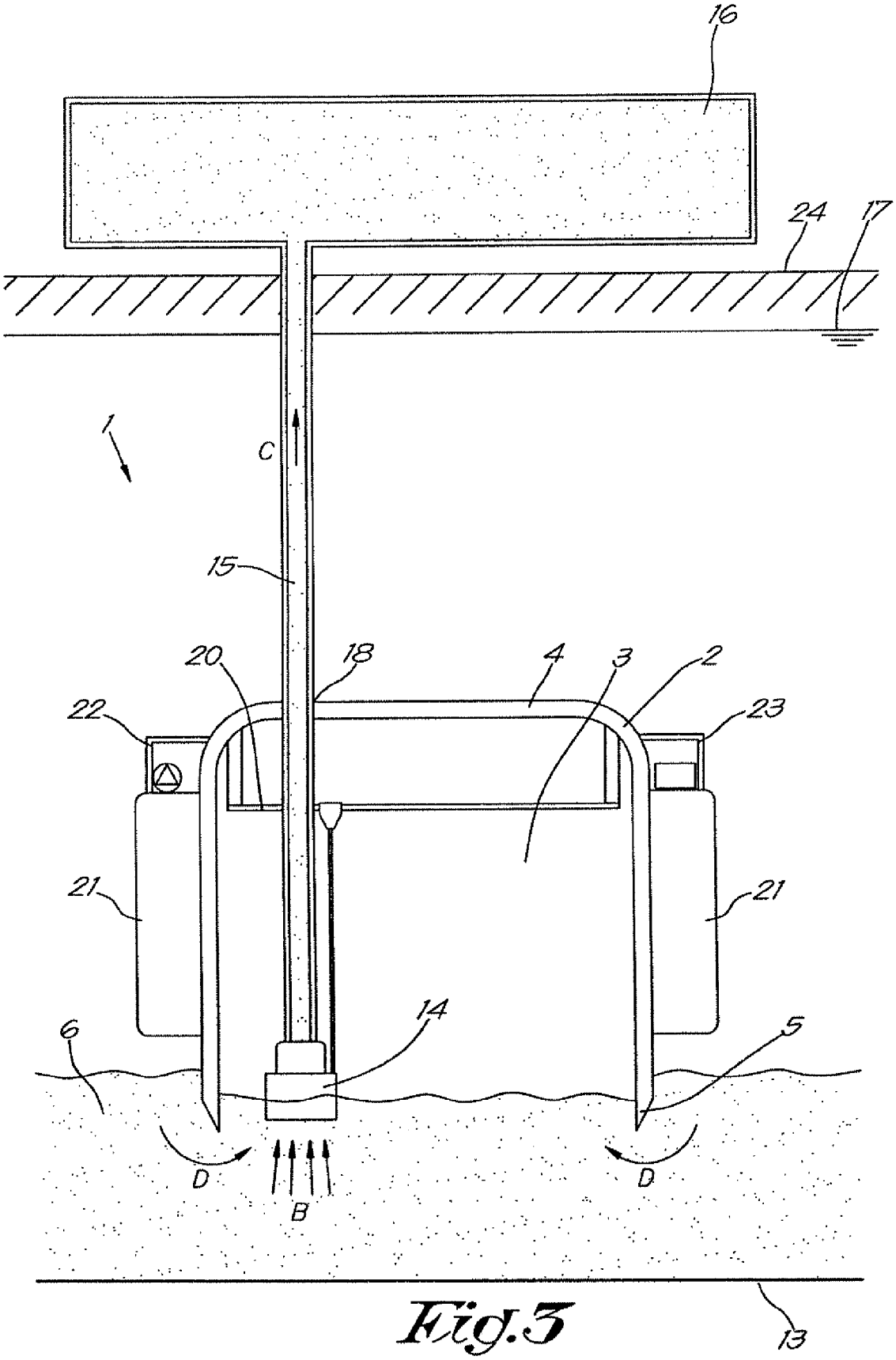

It is not excluded for the pump 14 to remove the alluvial deposits to a place of discharge 16 which is situated on shore, as is represented in FIG. 3. This is the case for example when a diving bell 2 is used that can be handled independently and a vessel 8 is not immediately required.

It is not excluded that several pumps 14 are provided in the diving bell 2 which are then connected to at least one place of discharge 16 by means of several tubes 15. This is indicated when a large volume of polluted alluvial deposits must be removed.

A practical example comprises 6 pumps 14 in a diving bell 2 for removing polluted alluvial deposits up to a depth of 30 m at a flow rate of 600 to 1000 $m^3/h$.

Naturally, in the above description, by air pressure in the chamber 3 of the diving bell 2 is meant the relative air pressure in relation to the water line 17, and not the absolute pressure in the chamber 3.

The present invention is by no means restricted to the method and embodiment described by way of example and represented in the accompanying drawings; on the contrary, such a method and device for removing alluvial deposits according to the invention can be realized in many different ways while still remaining within the scope of the invention.

The invention claimed is:

1. Method for removing alluvial deposits from a bottom of a watery area, comprising the steps: carrying a layer of alluvial deposits on the bottom of the watery area to a place of discharge and removing the alluvial deposits under a diving bell placed on or in the vicinity of the bottom of the watery area and in which an air pressure is generated which is practically equal to or larger than a pressure of a water column measured outside the diving bell as of the lower edge of the diving bell up to a water line; wherein removal of the alluvial deposits is carried out by providing a pump and sucking up the alluvial deposits in situ with the pump and carrying the alluvial deposits to the place of discharge via a tube.

2. Method for removing alluvial deposits according to claim 1, further comprising the step: providing the place of discharge on a vessel.

3. Method for removing alluvial deposits according to claim 2, further comprising the step: connecting the diving bell to the vessel by means of a shaft which is provided with a pressure pipe through which compressed air is supplied so as to produce the air pressure in the diving bell.

4. Method for removing alluvial deposits according to claim 1, wherein the provided pump is a plunger pump; and further comprising the steps of positioning the plunger pump and activating the plunger pump for sucking up the alluvial deposits.

5. Device for removing alluvial deposits from the bottom of a watery area, comprising a diving bell including a chamber which is open towards a bottom thereof and closed all around with a closed wall towards a top thereof; said chamber at least partly separating a mud layer to be removed in situ; and a pump in the chamber which is connected to a place of discharge for the alluvial deposits by a tube; including a shaft which connects the diving bell to a vessel, wherein the shaft contains a pressure pipe through which compressed air is supplied so as to provide an air pressure in the chamber which is practically equal to or larger than a pressure of a water column having a height as of the lower edge of the diving bell up to a water line.

6. Device for removing alluvial deposits according to claim 5, wherein the chamber has a tapered lower edge.

7. Device for removing alluvial deposits according to claim 6, wherein the tapered lower edge is provided with openings.

8. Device for removing alluvial deposits according to claim 5, wherein the tube is guided through a watertight opening in the closed wall.

9. Device for removing alluvial deposits according to claim 5, including a guide in the diving bell arranged to vertically and/or horizontally position the pump.

* * * * *